United States Patent [19]

Howson

[11] 4,207,933

[45] Jun. 17, 1980

[54] BOTTLE CONTENTS TRANSFER DEVICE

[75] Inventor: Edward H. Howson, Watertown, S. Dak.

[73] Assignee: D & D Electric, Inc., Watertown, S. Dak. ; a part interest

[21] Appl. No.: 743,409

[22] Filed: Nov. 19, 1976

[51] Int. Cl.[2] ..... B65B 3/06

[52] U.S. Cl. ..... 141/106; 141/375

[58] Field of Search ..... 141/106, 286, 311 R, 141/340–343, 363–366, 369, 375; 222/185

[56] References Cited

U.S. PATENT DOCUMENTS

| | | | |
|---|---|---|---|
| 1,899,095 | 2/1933 | Knight et al. | 141/341 X |
| 2,189,238 | 2/1940 | Benjamin | 141/363 X |
| 2,536,419 | 1/1951 | Brunell et al. | 141/364 X |
| 3,643,704 | 2/1972 | Carr | 141/106 |

*Primary Examiner*—Frederick R. Schmidt

*Attorney, Agent, or Firm*—Clarence A. O'Brien; Harvey B. Jacobson

[57] ABSTRACT

A bottle contents transfer device having a base arranged for resting on a support surface and supporting in an elevated position a retaining rack arranged for holding a bottle or bottles to be drained. Disposed between the retaining rack and the base of the device is a shelf provided with a hole in which a funnel is removably received for directing a substance being drained into a container supported by the base. An adapter permits a funnel to be mounted on the retaining rack so as to allow containers to be drained which are unsuited for support by the retaining rack. Control of fluid flow through the funnels is realized by use of a valve element manually placeable in and removable from the drain portion of the funnel or funnels employed with the device.

2 Claims, 6 Drawing Figures

BOTTLE CONTENTS TRANSFER DEVICE

BACKGROUND OF THE INVENTION

1. Field of the Invention

This invention relates generally to a device for transferring a flowable substance from one container to another container, and particularly to a device for filling a bottle, and the like, by transfer of the contents remaining in one or more partly empty bottles.

2. Description of the Prior Art

It is a common practice in establishments, such as restaurants, coffee shops, and the like, which serve catsup and other condiments to periodically empty the contents of partially used bottles of such condiments into other partly used bottles. This task, performed at least once daily, results in full bottles being available for the next period of business.

Some purveyors even purchase their condiments in bulk, such as in large cans, and like containers, so as to transfer the condiments to suitable bottles in order to realize a saving in the cost of condiments.

Various devices have been proposed for facilitating the operation of transferring the contents of one or more bottles into a bottle or other suitable container to be filled. U.S. Pat. Nos. 3,643,704, issued Feb. 22, 1972, to W. G. Carr, and 3,860,048, issued Jan. 14, 1975, to M. White, disclose examples of devices for such purpose. In the foremost of these two prior patents, the contents of one or more bottles is drained into a reservoir provided with a valve at the bottom thereof so that the contents of the reservoir may be selectively drained into a container disposed beneath the valve. The latter of the aforementioned two prior patents, on the other hand, discloses an arrangement wherein a container to be filled can be placed beneath a single container to be drained, with the transfer operation facilitated by use of a funnel inserted into the neck of the container to be filled. U.S. Pat. No. 3,230,986, issued Jan. 25, 1966, to D. O. Worley, discloses a bottle draining rack which is similar to the device disclosed in U.S. Pat. No. 3,860,048, except that the funnel is supported on the rack itself and only a single pair of bottles are to be disposed in the rack at a time, as opposed to a possible plurality of pairs of bottles disposed on the draining rack disclosed in U.S. Pat. No. 3,860,048. U.S. Pat. Nos. 192,348, issued June 26, 1877, to S. M. Preston, and 447,643, issued Mar. 3, 1891, to S. B. Kersey, disclose container content transfer racks employing funnels removably mounted on the rack structure. Finally, U.S. Pat. No. 3,156,272, issued Nov. 10, 1964, to W. G. Indrunas, discloses a bottle coupling device whereby a pair of bottles are coupled together in a vertically opposed relationship so as to permit the contents of the uppermost of the bottles to drain into the lowermost of the connected pair.

SUMMARY OF THE INVENTION

It is an object of the present invention to provide a bottle contents transfer device which facilitates the ease and speed by which an operator may perform a desired transfer.

It is another object of the present invention to provide a bottle contents transfer device of simple, yet rugged construction which permits versatile operation so as to carry out container contents transfers in many different situations.

It is yet another object of the present invention to provide a container contents transfer device which is constructed in such a manner that washing and/or sanitizing is easily accomplished in accordance with conventional health standards.

These and other objects are achieved according to the present invention by providing a container contents transfer device having: a base arranged for resting on a support surface; a container retaining rack arranged vertically disposed above the base for supporting a container to be drained; a support member connected to the base and to the retaining rack for mounting the retaining rack above the base; a shelf mounted on the support member between the retaining rack and the base for receiving a funnel; with a funnel being removably arranged on the shelf so as to be in alignment with the retaining rack and the base of the device.

The base advantageously forms a platform provided with a ledge disposed for facilitating retention on the base of a container to be filled.

The shelf advantageously includes a substantially planar member extending cantilever fashion from the support member and provided with a hole disposed for receiving the core of the funnel, while the retaining rack preferably includes a substantially planar midportion disposed substantially parallel to the planar member of the shelf means. A pair of outside planar portions extending toward the base of the device from the midportion of the retaining rack complete the latter. These outside portions diverge from the midportion of the rack at an acute angle with respect thereto, with each of the midportion and the two outside portions being provided with a respective aperture arranged for returning receiving the, for example, neck of a bottle or like container to be drained. The aperture provided in the midportion of the retaining rack is advantageously offset from the apertures provided in the outside portions of the rack in the direction toward the support member on which the rack is mounted in order to avoid interference between drainage from a bottle disposed in the midportion of the rack and bottle simultaneously disposed in the outside portions thereof. The support member of the device is preferably a plate extending along the back of the device, with the base, retaining rack, and shelf extending codirectionally from the support member toward a front or operating side of the device.

An adapter can be inserted into the aperture provided in, for example, the midportion of the retaining rack for permitting a funnel to be rigidly supported on the retaining rack. The fluid contents of a bottles, can, or other suitable container, can be poured into this funnel so as to permit the transfer of the contents of such a container, which is generally too large to be supported directly on the retaining rack, into a bottle or other receptacle suitable for placement on a table or counter in a restaurant, cafe, coffee shop, and the like.

A valve element is advantageously provided for use in conjunction with the funnel or funnels employed with the device according to the invention. This valve element is manually manipulable so as to be selectively and removably insertable into the opening provided in the bottom of a funnel in the usual manner for blocking fluid from the cone of the funnel through the outlet passage provided in the stem thereof. Manual removal of the valve element from such opening will permit fluid to flow from the funnel down through the passage provided in the stem into a container or further funnel disposed beneath the funnel.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
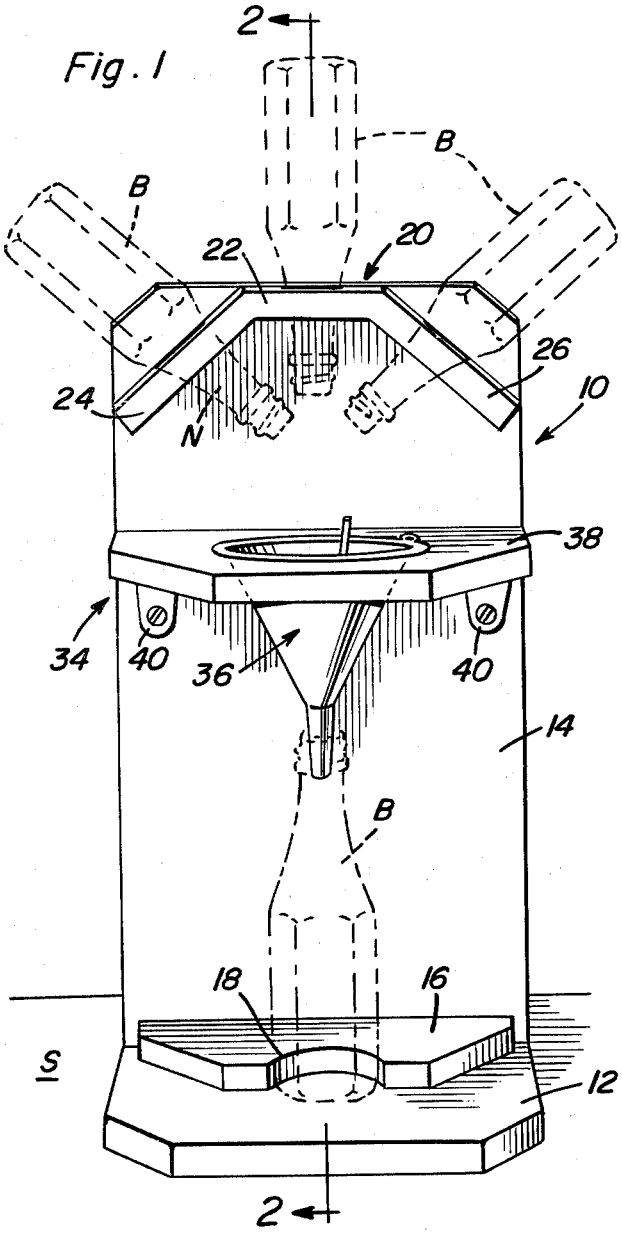
FIG. 1 is a front perspective view showing a container contents transfer device according to the present invention.
Figure 2:
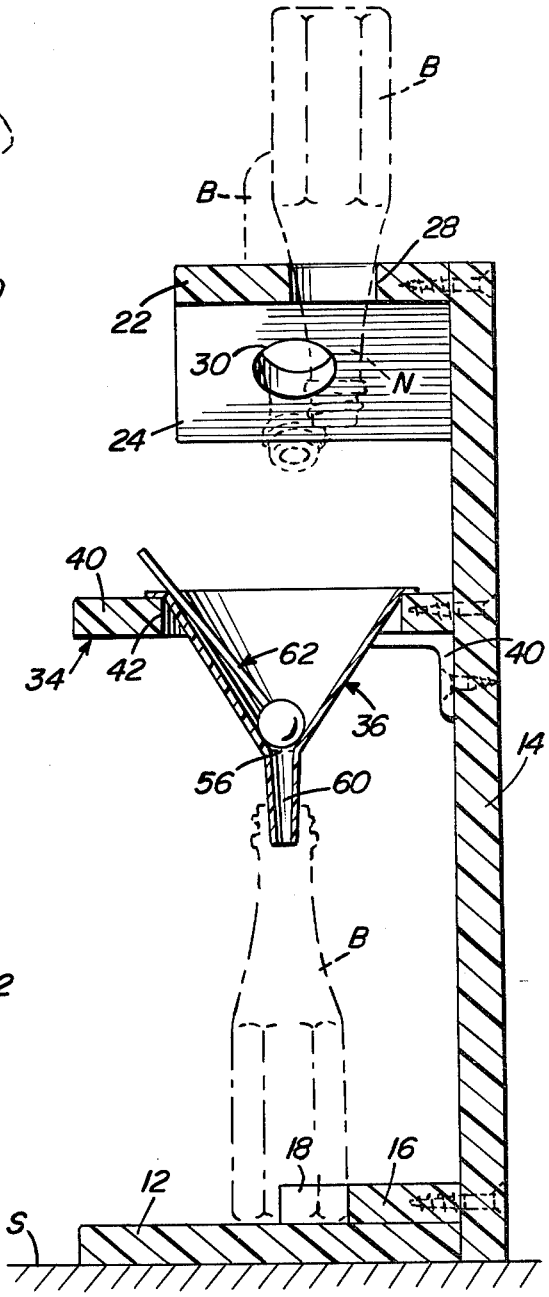
FIG. 2 is an enlarged, sectional view taken generally along the line 2—2 of FIG. 1.
Figure 3:
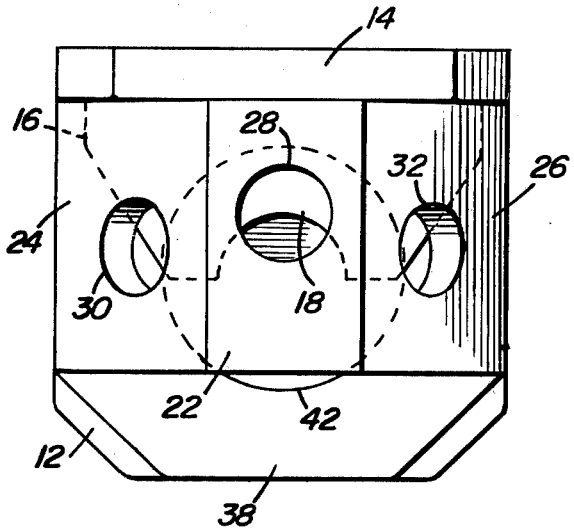
FIG. 3 is a top plan view showing the container contents transfer device of FIGS. 1 and 2.

Referring now more particularly to FIGS. 1 through 3 of the drawings, a container contents transfer device 10 according to the invention includes a base 12 arranged for resting on a support surface S and having connected thereto so as to extend vertically therefrom a substantially planar support member 14. As can be appreciated from the drawings, support member 14 is connected to base 12 along a generally planar backside thereof. Base 12 forms a container supporting platform provided with a ledge 16 having a semi-circular recess 18 for receiving a container to be filled. By this arrangement, a container, such as a bottle B, is retained on base 12 in a reasonably secure manner so as to prevent accidental tipping over of the container.

Arranged vertically above base 12 for supporting a container or containers to be drained, such as the illustrated plurality of bottles B, is a retaining rack 20 including a substantially planar midportion 22 and a pair of also substantially planar outside portions 24 and 26. The latter extend toward base 12 from midportion 22 so as to diverge from one another at an acute angle with respect to midportion 22 and with respect to one another. Each of the midportion 22 and the outside portions 24 and 26 are provided with a respective aperture 28, 30 and 32 arranged for retainingly receiving a neck N of a bottle B to be drained. The aperture 28 provided in midportion 22 of rack 20 is advantageously offset relative to apertures 30 and 32, provided in the portions 24 and 26, in the direction toward the support member 14 in order to prevent interference between drainage from the bottles B disposed in the apertures of the various portions 22, 24 and 26 of retaining rack 20.

A shelf 34 is mounted on support member 14 between the rack 20 and the base 12 for receiving a funnel 36. Shelf 34 includes a substantially planar member 38 extending cantilever fashion from the support member 14, and retained thereon as by conventional angle brackets 40 and suitable screw fasteners, and is provided with a hole 42 disposed for receiving the conventional cone portion of the funnel 36. As can be appreciated, the funnel 36 will collect contents of the bottles B disposed in the rack 20 which is drained from these bottles B under the force of gravity, and will transfer the contents received to another bottle B disposed on base 12 beneath the funnel 36.

Figure 4:
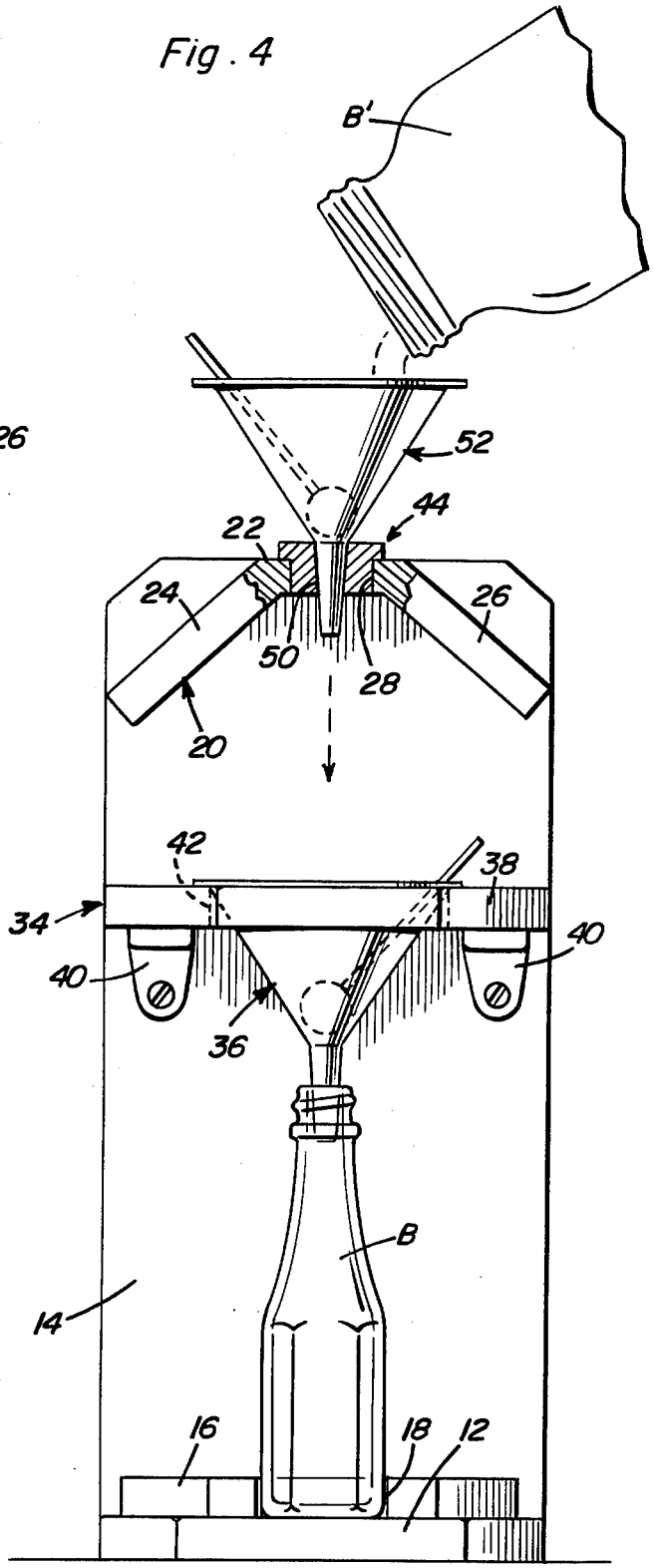
FIG. 4 is a front elevational view showing a modified arrangement of container contents transfer device according to the present invention.
Figure 5:
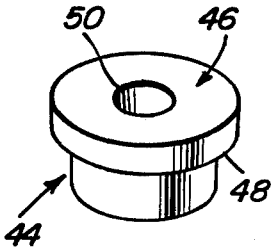
FIG. 5 is a perspective view showing an adapter used with the arrangement of the invention seen in FIG. 4.

Referring now more particularly to FIGS. 4 and 5 of the drawings, the contents of a large-mouth bottle B', and the like, can be transferred to a conventional table-size bottle B by use of a device 10 according to the invention by means of a suitable adapter 44 comprising a body 46 having a substantially cylindrical shape and provided with a step 48 and a through bore 50. The body 46 is insertable in, for example, the aperture 28 of midportion 22 of rack 20 for receiving the stem of a further funnel 52.

Figure 6:
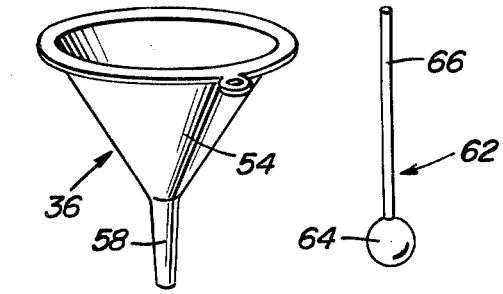
FIG. 6 is an exploded, perspective view showing a funnel and valve element arrangement according to the present invention for use with a container contents transfer device according to the invention.

As can be seen from FIGS. 2 and 6 of the drawings, the funnel 36 includes a cone 54 converging from an open top portion to a bottom opening 56 at which point a stem 58 is connected to cone 54 and itself is provided with a through passage terminating at opening 56 so as to communicate with the interior of cone 54. It will be appreciated that funnel 52 can be constructed in the identical manner to funnel 36, as described immediately above, and that the valve element employed with funnel 52 can be identical to the valve element 62 employed with funnel 36. This valve element 62, which is selectively, removably insertable in opening 56, as by the force of gravity and the weight of any fluid substance present in cone 54, normally blocks fluid flow from cone 54 and through passage 60 by a ball 64 connected to a rod 66 which forms a handle permitting manipulation of the valve element 62 as by an operator (not shown) of device 10.

In operation, partially consumed bottles B are placed in the apertures 28, 30 and 32 as shown in FIG. 1. The contents of the bottles B so placed drain into the funnel 36 disposed below the bottles B so as to be drawn off into the bottle B disposed on base 12 in a manner controlled by use of the valve element 62. Experience has shown that unless the bottles B to be drained are at a proper slant, an air-lock can be formed within the bottles which will retard flow therefrom. Thus, the two side apertures 30 and 32 provided in outside portions 24 and 26, respectively, of rack 20 hold bottles B at a proper slant to assure flow. The top center aperture 28 permits holding a bottle B vertically, therefore draining the last remaining dregs from such a bottle.

For those wishing to use the catsup or other condiment in bulk, usually as provided in one gallon containers, the adapter 44 is inserted in the top aperture 28 of rack 20. The funnel 52 provided with adapter 44 is placed within bore 50 in such a manner as to be held firmly in upright. A larger funnel than that illustrated can be substituted, if desired, thus saving pouring operations from the bulk container into the funnel 52. As mentioned above, valve element 62 is used for control of the flow. In actual practice, the valve element 62 employed with funnel 52 can be the same valve elements 62 as employed with funnel 36.

As can be readily understood from the above description and from the drawings, a container contents transfer device according to the present invention provides a simple yet rugged and reliable structure for effecting container transfers. Further, dishwashing and/or sanitizing of the device is easily accomplished by removing the retaining rack, shelf and funnel or funnels from the device and processing them in the usual manner. The device which is preferably constructed from a suitable polymeric resin, and the like, in a conventional manner, is also easily cleaned with a cloth and water. There are no sharp corners or crevices to reach. By constructing the device from, for example, a synthetic resin as by casting or molding, the component parts can be made sufficiently strong while impervious to customary dishwashing.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A container contents transfer device, comprising, in combination:

(a) a planar base arranged for resting on a support surface;

(b) container retaining means arranged vertically above the base for supporting a container to be drained; and (c) support means connected to the base and to the retaining means for mounting the retaining means above the base, the container retaining means including a substantially planar midportion arranged substantially parallel to the base, and a pair of outside planar portions extending toward the base in opposite directions from the midportion and diverging from one another at an acute angle with respect to the plane of the midportion, each of the midportion and the outside portions being provided with a respective aperture each forming means for retainingly receiving a neck of a bottle to be drained, the aperture provided in the midportion of the retaining means being in the direction toward the support means from the apertures provided in the outside portions of the retaining means in order to prevent interference between drainage from bottles disposed in the apertures of the various portions; and (d) shelf means mounted on the support means spaced from and disposed between the retaining means and the base for receiving a funnel, the shelf means including a substantially planar member extending cantilever fashion from the support means substantially parallel to the base and provided with a hole disposed for receiving the funnel.

2. A device as defined in claim 1, further including an adapter comprising a body having a cylindrical shape provided with a step and a through bore, the body inserted in the aperture of the midportion of the retaining means for receiving a funnel and permitting transfer of the fluid contents of a container too large to be supported by the retaining means.

* * * * *